US007018092B2

(12) United States Patent
Müller

(10) Patent No.: US 7,018,092 B2
(45) Date of Patent: Mar. 28, 2006

(54) SPIRAL SPRING FOR TIME MEASURING DEVICE

(75) Inventor: Francesco Müller, Genthod (CH)

(73) Assignee: Franck Muller Watchland S.A., (CH)

( * ) Notice: Subject to any disclaimer, the term of this patent is extended or adjusted under 35 U.S.C. 154(b) by 0 days.

(21) Appl. No.: 10/383,035

(22) Filed: Mar. 6, 2003

(65) Prior Publication Data

US 2004/0174775 A1 Sep. 9, 2004

(51) Int. Cl.
*G04B 1/10* (2006.01)

(52) U.S. Cl. ..... 368/140; 368/175; 267/272

(58) Field of Classification Search ..... 368/175–177, 368/140, 174, 327, 144; 267/160, 154, 272, 267/273; 185/37–39, 45, 40 R, 40 A–40 F, 185/40 H, 40 L, 40 N, 40 S; 310/355; 81/6, 81/7.5; 248/624, 625, 630; 420/417, 422
See application file for complete search history.

(56) References Cited

U.S. PATENT DOCUMENTS

| | | | | | |
|---|---|---|---|---|---|
| 2,335,974 | A | * | 12/1943 | Simpson | 368/177 |
| 2,842,935 | A | * | 7/1958 | Bradley | 368/177 |
| 3,599,423 | A | * | 8/1971 | Beguin et al. | 368/171 |
| 3,673,376 | A | * | 6/1972 | Kullmann | 219/121.64 |
| 3,696,607 | A | * | 10/1972 | Dinerstein | 368/185 |
| 3,846,612 | A | * | 11/1974 | Augsburger | 219/121.85 |
| 3,871,095 | A | * | 3/1975 | Miyamoto et al. | 29/896.31 |
| 3,896,614 | A | * | 7/1975 | Bachmann | 368/175 |
| 3,956,881 | A | * | 5/1976 | Vuille et al. | 368/177 |
| 5,907,524 | A | * | 5/1999 | Marmy et al. | 368/175 |

* cited by examiner

*Primary Examiner*—Kamand Cuneo
*Assistant Examiner*—Thanh S. Phan
(74) *Attorney, Agent, or Firm*—Lerner, David, Littenberg, Krumholz & Mentlik, LLP

(57) ABSTRACT

A spiral spring for use in connection with horology instruments is disclosed which includes a spiral spring and a collet which are produced in one piece without molecular discontinuity.

8 Claims, 3 Drawing Sheets

SPIRAL SPRING FOR TIME MEASURING DEVICE

FIELD OF THE INVENTION

The present invention relates to a spiral spring for a horology instrument for measuring time.

BACKGROUND OF THE INVENTION

The spiral springs usually used in horology are made up of several parts, which have to be produced with great accuracy and then assembled to form a composite part. The complexity of the production of such parts generates high costs and complex adjustments.

One object of the present invention is to propose a spiral spring with as low a production cost as possible and, if possible, without any operating defects.

SUMMARY OF THE INVENTION

In accordance with the present invention, this and other objects have now been realized by the invention of a spiral spring for use in a time measuring device comprising a spiral spring body and a collet produced in one piece and without molecular discontinuity between the spiral spring body and the collet. In a preferred embodiment, the spiral spring includes a terminal curve and a stud, wherein the terminal curve and the stud are also produced in one piece and without molecular discontinuity with the spiral spring body and the collet.

In accordance with one embodiment of the spiral spring of the present invention, the spiral spring body comprises a leaf having a predetermined height, and the stud comprises a circular cylinder having a height which corresponds to the predetermined height.

In accordance with another embodiment of the spiral spring of the present invention, the spiral spring body comprises a leaf having a predetermined width, and the stud has a width which is greater than the predetermined width and a degree of flexibility enabling the stud to be inserted by friction into a cavity.

In accordance with another embodiment of the spiral spring of the present invention, the stud comprises a pair of flexible circular arms.

In accordance with a preferred embodiment of the spiral spring of the present invention, the spiral spring includes a support including a first aperture and a second aperture crossing the first aperture, the stud being inserted by friction into the first aperture and being locked in the support by releasing its elastic tension in the second aperture.

In accordance with another embodiment of the spiral spring of the present invention, the collet includes a slot and a pair of open areas permitting the spiral spring to be balanced statically and to be gripped with an assembly tool. Preferably, the collet includes notches in its peripheral area.

In accordance with another embodiment of the spiral spring of the present invention, the stud comprises a widened extremity at the end of the spiral spring body and at least one notch thereon, and including a support containing a screw and a bearing bush, whereby the at least one notch in the extremity meshes with the threads of the screw and the bearing bush serves as a point of attachment for the spiral spring body.

In accordance with another embodiment of the spiral spring of the present invention, the spiral spring is produced by a single operation. Preferably, the single operation comprises an operation selected from the group consisting of micromolding, molding by means of molds produced by the exposure of UV-sensitive resins, galvanic deposition processes, galvanic deposition processes with a mold, projection of material, conventional cutting, laser cutting, wire EDM, die-sinking EDM, stamping, and the cutting of sheets utilizing a high pressure liquid jet.

The spiral spring in accordance with the present invention is entirely produced in one piece without molecular discontinuity with its collet.

A high quality, perfectly balanced part has been produced with the spiral spring in accordance with the present invention. The fact that it was produced all in one piece without discontinuity avoids defects inherent in conventional production, and in particular avoids internal stresses in the material and a lack of accuracy in the assembly of the constituent parts. Moreover, the cost of the spiral spring in accordance with the present invention is considerably reduced relative to the springs of the prior art.

The production of the spiral spring in accordance with the present invention can be carried out advantageously using known techniques, for example through macromolding operations, by molding with molds made by the exposure of UV-sensitive resins, by galvanic deposition processes with or without a mold, by the projection of material or by conventional cutting, particularly by laser, wire EDM or die-sinking EDM, by stamping or by the cutting of sheets of material by a high-pressure liquid jet.

The spiral spring may have a stud, also made all in one piece without molecular discontinuity with its terminal curve. The stud may be in the form of a circular cylinder with the same height as the leaf of the spiral spring. The stud may be in the form of a part which is wider than the leaf, offering a certain flexibility allowing it to be inserted by friction into a cavity, and the wider part may be produced in the form of two flexible circular arms. The stud may be inserted by friction into a hole in a support, with the stud being locked by releasing its elastic tension in a hole that is perpendicular to or axially crosses the hole made in the support.

In the spiral spring in accordance with one embodiment of the present invention, the collet has a slot and two openings allowing for the part to be statically balanced and gripped with an assembly tool.

The collet may also have reference notches around its edge.

The extremity produced all in one piece with the terminal curve may have one or more notches that mesh with the thread of a screw, the screw being held axially in the support and a bearing bush housed in the support being used as a point of attachment for the spiral.

Finally, the spiral spring may be produced by micromolding techniques, by molding with molds made by the exposure of UV-sensitive resins, by galvanic deposition processes with or without a mold, by the projection of material or by conventional cutting, particularly by laser, wire EDM or die-sinking EDM, by stamping or by the cutting of sheets of material by high-pressure liquid jet.

BRIEF DESCRIPTION OF THE DRAWINGS

The present invention may be more fully understood with reference to the following detailed description, which demonstrates several methods of implementation of the spiral spring in accordance with the invention, with reference to the drawings in which.

DETAILED DESCRIPTION

Figure 1:
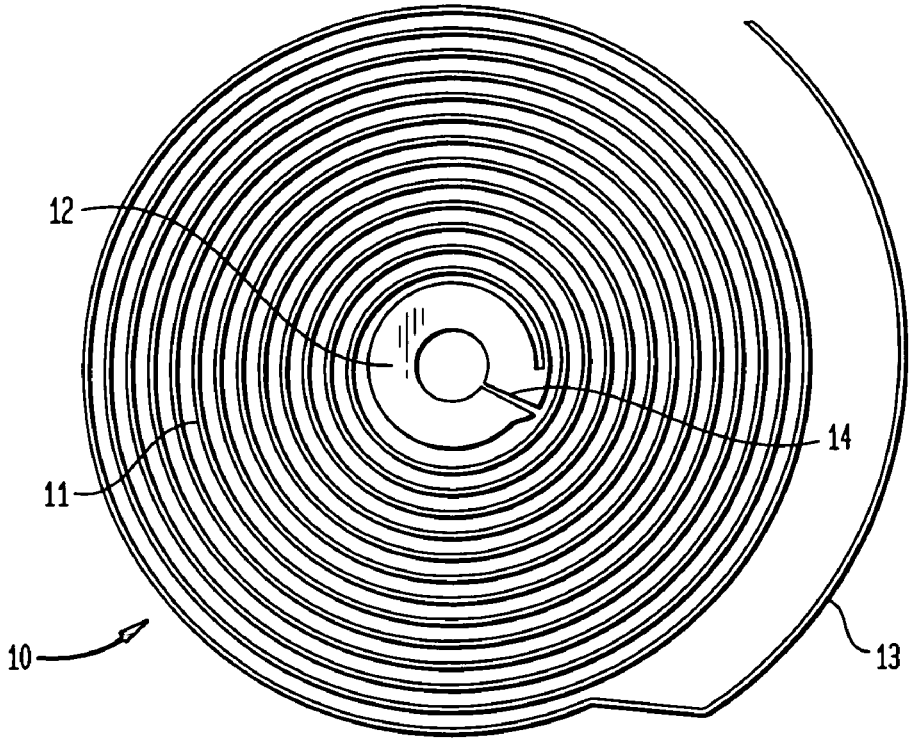
FIG. 1 is a top, elevational view of one embodiment of the spiral spring according to the present invention.

The spiral spring shown in FIG. 1 is made up of a leaf 11 with a collet 12 in its center and a terminal curve 13 at its outside extremity.

The part shown in FIG. 1, with its components, 11, 12, and 13, is made all in one piece without discontinuity in its molecular structure.

It can be made using the following techniques:

Macromolding technique, consisting of depositing a metal inside a mold using a galvanic process.

By the projection of metal onto a base.

By conventional cutting of a sheet of material.

By cutting of a sheet of material by high-pressure liquid jet.

Figure 2:
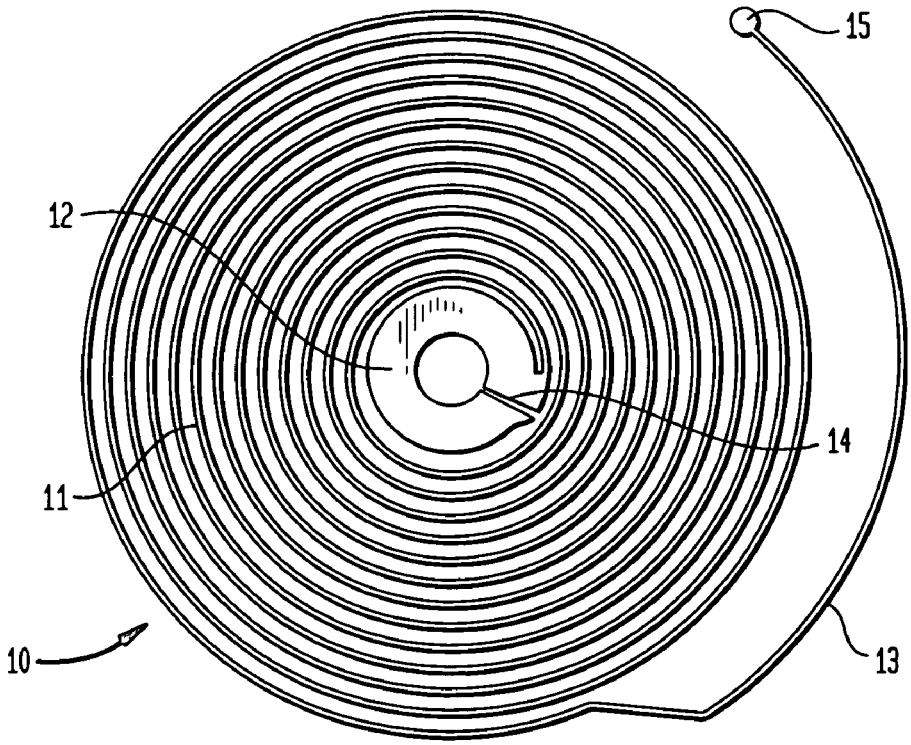
FIG. 2 is a top, elevational view of another embodiment of the spiral spring of the present invention.
Figure 3:
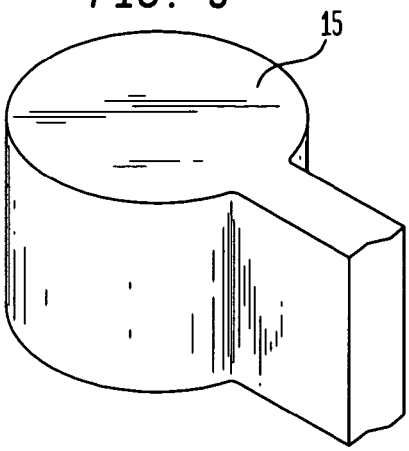
FIG. 3 is a side, perspective view of a stud placed at the outside extremity of the spiral spring of the present invention.

The application of the techniques mentioned above were used to produce the spiral spring shown in FIG. 1 and the variants shown in FIGS. 2 and 3, with satisfactory results. They were used to obtain the spiral springs in accordance with the present invention all in one piece and without molecular discontinuity. The macromolding production technique in particular gave excellent results.

As shown in FIG. 1, the collet 12 is in the form of a large circular ring and has a slot 14 enabling it to be driven onto a pin without splitting and without buckling on assembly.

The variant shown in FIG. 2 shows the spiral spring 11 with its collet 12 with a slot 14 and its terminal curve 13.

At the extremity of the terminal curve 13 there is a circular stud 15 made all in one piece without molecular discontinuity with the spiral and its collet; obviously, the shape of the stud 15 is not restricted to a circuit configuration and the stud may be made in any shape desired, for example in a circular shape with a slot as in traditional horology, or in any other suitable geometric shape, and a hole can be made in the center of the knob on the extremity to facilitate its fixing.

The stud 15 in FIG. 2 is shown in perspective and on a larger scale in FIG. 3.

Figure 4:
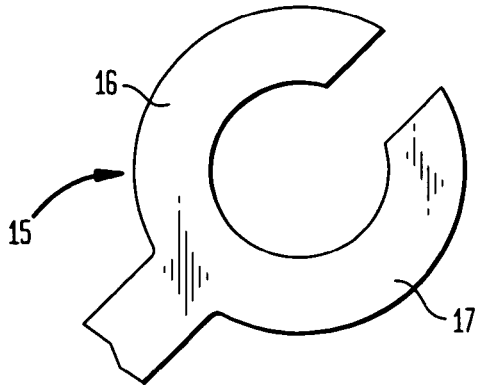
FIG. 4 is a top, elevational view of another embodiment of the stud shown in FIG. 3.
Figure 5:
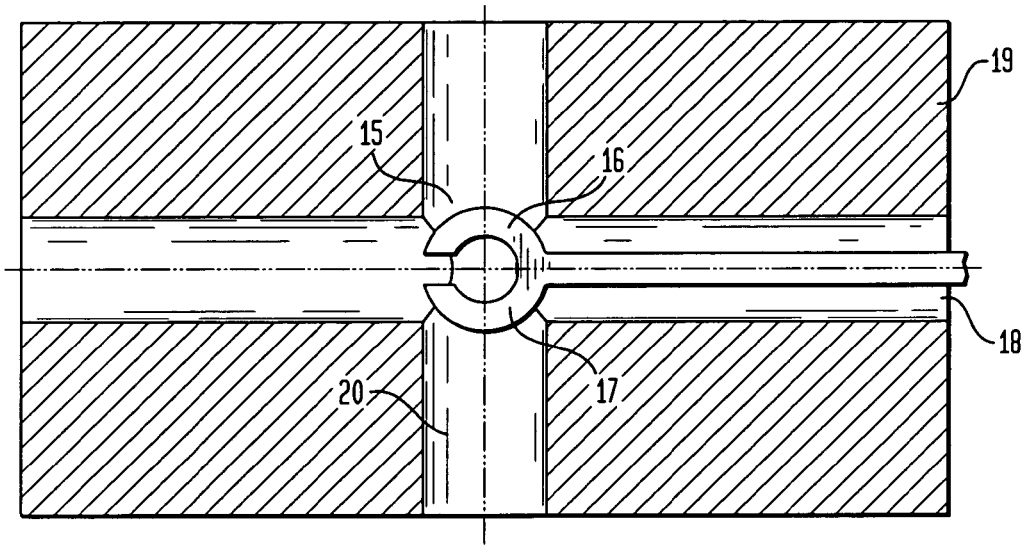
FIG. 5 is top, elevational, schematic view of a point of attachment for the stud shown in FIG. 4, which can be fixed to a conventional stud holder or to the bottom plate of a clock or to a balance bridge.

FIG. 4 shows a variant of the stud 15, which has two circular arms 16 and 17 with a certain flexibility. The stud in FIG. 4 may, given its flexible nature, be inserted by friction into a hole 13 in a movable stud holder 19 or a bottom plate 19 of the horology part. The part 19 has a perpendicular hole 20 in which the stud 15 in the method of implementation shown in FIG. 4 is locked, after the arms 16 and 17 have returned to their initial positions.

Figure 6:
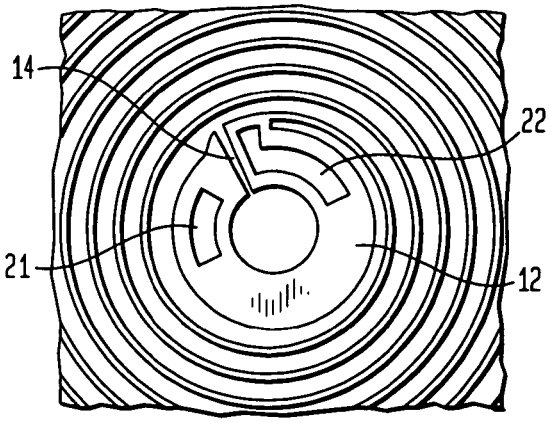
FIG. 6 is a top, elevational, partial view of one embodiment of the collet used in the spiral spring of the present invention.

The collet 12 shown in FIG. 6 with its slot 14 has two openings 21 and 22 used firstly to provide static balance to the assembly made up of the leaf 11, the collet and, depending on the case, the terminal curve 13, and secondly to facilitate the manipulation and gripping of the part with a tool.

Figure 7:
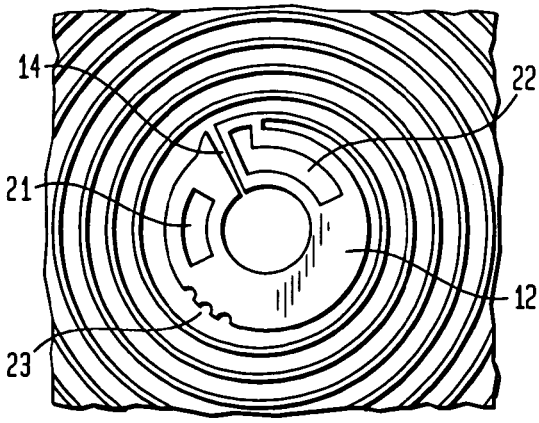
FIG. 7 is a top, elevational, partially sectional view of another embodiment of the collet shown in FIG. 6.

In the variant shown in FIG. 7, a number of notches are used to distinguish the type of spiral spring. FIG. 7 shows three notches 23; however, the shape and number of the notches can be chosen as needed. The method of implementation shown in FIG. 3 has a spiral ring 30 like the spring in the previous methods of implementation, with its collet 12, the slot 14 and its terminal curve 13.

Figure 8:
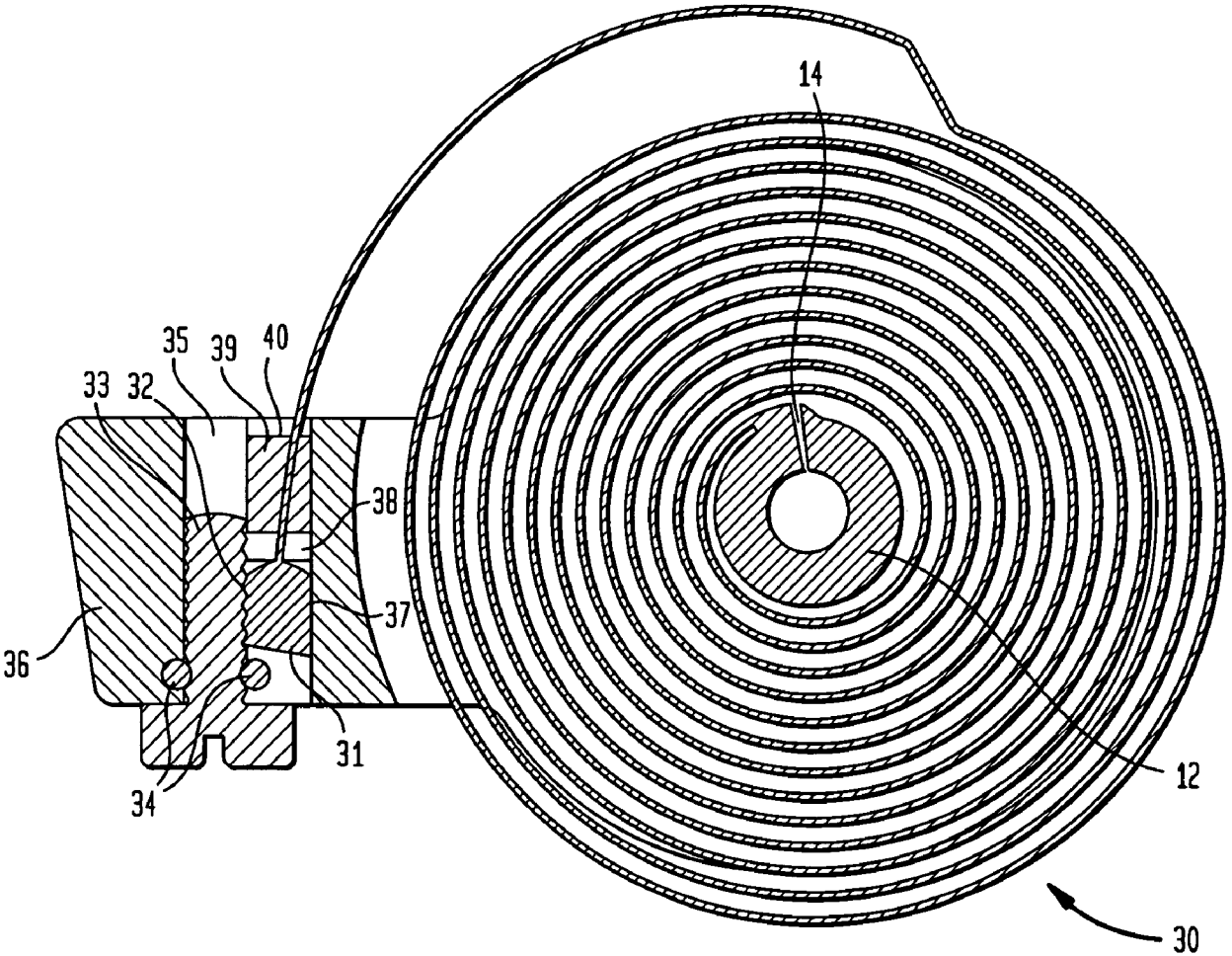
FIG. 8 is a top, elevational, partially sectional view of another embodiment of the spiral spring of the present invention and its adjustment.

Here, as shown in FIG. 8, the stud is in the form of a widened extremity 31 produced without molecular discontinuity with the terminal curve 13. The extremity 31 has notches 32 that mesh with the thread on a screw 33 held by means of two pins 34 inside a hole 35 in a support 36.

The part opposite the teeth 32 of the extremity 31 has a smooth surface 37 allowing the extremity 31 to slide against a surface 38 on the support 36 under the rotating action of the screw 33. The rotation of the screw 33 is therefore used to adjust the position of the extremity 31 in order to vary the active length of the terminal curve 13.

A bearing bush 39 made of a synthetic material or of metal is used to hold the point of attachment 40 of the spiral laterally by friction.

The method of implementation that has just been described and the previous methods of implementation were produced advantageously from a non-magnetic stainless metal alloy using the macromolding method.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A spiral spring for use in a time measuring device comprising a spiral spring body, collet, a terminal curve and a stud produced in one piece and without molecular discontinuity between said spiral spring body, said collet, said terminal curve and said stud.

2. The spiral spring according to claim 1 wherein said spiral spring body comprises a leaf having a predetermined height, and wherein said stud comprises a circular cylinder having a height which corresponds to said predetermined height.

3. The spiral spring according to claim 1 wherein said spiral spring body comprises a leaf having a predetermined width, and wherein said stud has a width which is greater than said predetermined width and a degree of flexibility enabling said stud to be inserted by friction into a cavity.

4. The spiral spring according to claim 3 further comprising a support including a first aperture and a second aperture crossing said first aperture, said stud being inserted by friction into said first aperture and being locked in said support by releasing its elastic tension in said second aperture.

5. The spiral spring according to claim 1 wherein said stud comprises a pair of flexible circular arms.

6. The spiral spring according to claim 1 wherein said collet includes a slot and a pair of open areas permitting said spiral spring to be balanced statically and to be gripped with an assembly tool.

7. The spiral spring according to claim 6 wherein said collet includes notches in its peripheral area.

8. The spiral spring according to claim 1 wherein said stud comprises a widened extremity at the end of said spiral spring body and at least one notch thereon, and including a support containing a screw and a bearing bush, whereby said at least one notch in said extremity meshes with the threads of said screw and said bearing bush serves as a point of attachment for said spiral spring body.

* * * * *